US005483987A

United States Patent [19]

Amaudric du Chaffaut et al.

[11] Patent Number: 5,483,987

[45] Date of Patent: Jan. 16, 1996

[54] REMOTE CONTROL METHOD AND DEVICE FOR ACTUATING AN EQUIPMENT-APPLICATION TO A DRILL STRING

[75] Inventors: Benoit Amaudric du Chaffaut, Voisins Le Bretonneux; Jean Boulet, Paris, both of France

[73] Assignee: Institut Francais Du Petrole, Rueil-Malmaison, France

[21] Appl. No.: 362,952

[22] Filed: Dec. 23, 1994

[30] Foreign Application Priority Data

Dec. 24, 1993 [FR] France ..... 93 15720

[51] Int. Cl.[6] ..... E21B 34/10

[52] U.S. Cl. ..... 137/2; 137/504; 166/240; 175/61

[58] Field of Search ..... 137/2, 504; 175/61; 166/240, 334, 374

[56] References Cited

U.S. PATENT DOCUMENTS 3,024,845 3/1962 Conrad ..... 166/240 X

FOREIGN PATENT DOCUMENTS 0372594 6/1990 European Pat. Off. .
2670824 6/1992 France .

*Primary Examiner*—Robert G. Nilson
*Attorney, Agent, or Firm*—Millen, White, Zelano, & Branigan

[57] ABSTRACT

The present invention relates to a device for actuating equipment from a distance through a flow variation of a fluid in a pipe. The device and method of this invention are suited for incorporation into a drill string.

12 Claims, 2 Drawing Sheets

REMOTE CONTROL METHOD AND DEVICE FOR ACTUATING AN EQUIPMENT-APPLICATION TO A DRILL STRING

FIELD OF THE INVENTION

The present invention relates to a device and to a method for actuating from a distance an equipment used in connection with pipes in which a fluid circulates. Actuation is achieved through a variation of the circulation rate of a fluid. The device according to the present invention includes means for controlling means suited for adjusting the flow of the fluid in the pipe.

BACKGROUND OF THE INVENTION

In the field of petroleum drilling, it is often necessary, to actuate from a distance tools or equipments placed in the wellbore.

According to the prior art, an annular piston having two faces and a throttle element including a needle-flow bean of variable opening area are used. One face of this piston is subjected to the pressure forces prevailing on one side of the throttle elememt, the other face being subjected to the pressure forces on the other side of the throttle element.

The flow bean is generally borne by the piston and the needle is fastened to a pipe containing the assembly and in which the piston can move to perform the desired actuation. The piston includes return means which keep it in a position of rest corresponding to a relatively large opening area of the throttle element, leading to a low pressure drop for working flow rates.

When one wishes to actuate the equipment, the flow rate is increased, which increases the pressure drop on either side of the throttle element and the piston therefore tends to move by acting against the return means. During this motion, the flow bean enters the throttle element increasingly deep, hence a higher increase in the pressure drop providing the power for actuating the equipment.

The prior art may be illustrated by patent FR-2,575,793.

However, such a device lacks precision concerning the flow rate threshold leading to the actuation initiation. In fact, the assembly consisting of the piston and the return spring, which must react to or transmit high powers, cannot be precisely sensitive to a given flow rate threshold, for example because of frictional stresses.

Furthermore, this device works through a flow rate increase with respect to the working flow rates. Now, drilling conditions may prevent such a flow rate increase. In fact, the increase due to pressure drops downstream from the device may lead to fracturations in the formation or destabilize the walls of the well, whereby the operation safety may be questioned. Besides, a power increase with respect to the power used for drilling is often impossible because the pumping equipment already frequently works at full power for the drilling operation itself.

Patent FR-2,641,320 solves the problem of the flow rate threshold precision by using a flow bean or a needle borne by the piston, but mobile with respect to this piston.

This flow bean or this needle, of small size compared to the piston and equipped with appropriate return means, is precisely sensitive to a flow rate threshold. However, actuation still presents the major drawback of being initiated by a flow rate increase with respect to working flow rates.

Application FR-2,670,824 also describes a known device allowing the two problems to be solved by using a needle-flow bean system or an equivalent. This device allows notably actuation to be initiated from a flow rate threshold lower than or equal to working flow rates, while providing a high activation force such as that necessary for actuation.

Document FR-2,670,824 filed by the applicant discloses an actuating device in which the partial throttling system of the fluid passageway is adjusted according to two positions: an actuation position and a position called a drilling position where no actuation is possible. Adjustment is either remote controlled from the surface, or occupies successively the two positions by using an appropriate operational sequence. This device presents the drawback of requiring a complex remote drive or, in the other case, of having a method of operation which gives no reliable information on the real position of the throttling system.

The present invention widely solves the drawbacks cited above by using a fluid passageway throttling system which is adjusted by the hydrodynamic action of the fluid and by an improved system for controlling the adjusting means, allowing the operator to be certain of being either in the drilling position, or in the equipment activation position.

SUMMARY OF THE INVENTION

The present invention relates to a method for actuating an equipment from a distance, said actuation being achieved by a variation of the conditions of flow of a fluid in a pipe, said equipment including means of coupling with an actuating device which comprises adjusting means suited for varying the geometric characteristics of the passageway of said fluid through the hydrodynamic action of the flow of said fluid in said pipe. The method comprises the following stages:

varying the circulation rate at least between a value Qmini and a value Qf, Qmini being less than Qf, performing a first variation of the circulation rate from one or the other of said values Qf or Qmini so as to reach a value Qr, Qr being an intermediate flow rate value between Qmini and Qf, then performing a second variation from Qr in the opposite direction with respect to said first variation.

According to the method, said equipment cannot be activated when a flow rate variation is performed between a value at most equal to Qmini and a value at least equal to Qf and conversely.

The method may comprise the following stages:

performing said first variation from a flow rate value at most equal to Qmini and up to value Qr, then performing said second variation in the opposite direction at least to value Qmini, then performing another flow rate variation in the same direction as said first one up to a value Qa for which said equipment is activated.

The method may comprise the following stages:

performing said first variation from a flow rate value at least equal to Qf and up to value Qr, then performing said second variation in the opposite direction at least up to a value Qa for which said equipment is activated.

The invention further relates to a device for actuating an equipment from a distance, said actuation being performed through a variation of the conditions of flow of a fluid in a pipe, including coupling means between said device and said equipment, adjusting means suited for varying the geometric characteristics of the passageway of said fluid by the hydrodynamic action of the flow of said fluid in said pipe, said adjusting means including a continuous groove consisting of at least one set including three groove sections delimited each by an origin point and an end point, indexing means co-operating with said groove, the position of said indexing means in said groove corresponding to an adjustment of said adjusting means. According to the invention, one of the origin or end points of one of the sections is located between the origin point and the end point of another section.

Said sections may include a system preventing said indexing means located at the end point of one of the sections from being moved in the direction of the origin point of this section.

The system may include a retractable finger and a groove of variable depth.

Said set may include three sections. The origin point of a second section may correspond to the end point of the first section. The end point of the second one may be located between the end point and the origin point of a third section and the end point of the third section may correspond to the origin point of another set.

Said set may include at least three sections. The end point of a first section may merge with the origin point of a second section whose end point merges with the origin point of another set. The origin point of a third section may be located between the origin point and the end point of the first section, the end point of said third section may merge with the origin point of a subset of continuous grooves whose end point merges with the end point of the second section. The subset may include at least two V-shaped sections, and when said indexing means is located at the point of the V, said adjusting means allow activation. When the indexing means is located at the common point of the first section and of the second section, said adjusting means do not allow activation. The invention may be applied to remote control of equipments incorporated to a drill string, for example a variable-geometry stabilizer or a variable-angle elbow pipe.

BRIEF DESCRIPTION OF THE DRAWINGS

Other features and advantages of the present invention will be clear from reading the description hereafter given by way of non limitative particular examples, with reference to the accompanying drawings in which.

DESCRIPTION OF THE PREFERRED EMBODIMENTS

Figure 1:
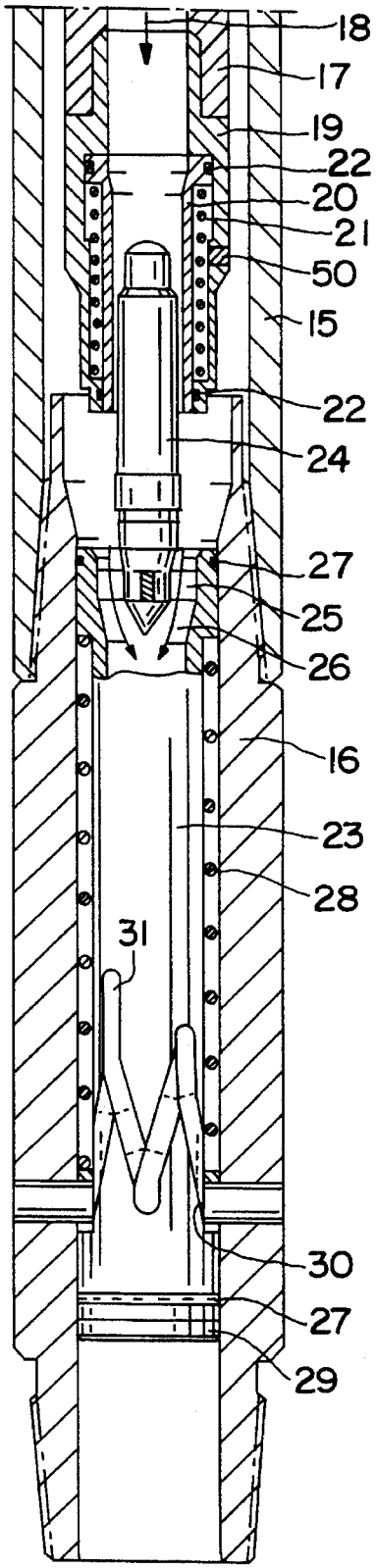
FIG. 1 PRIOR ART
FIGS. 1 and 1A illustrate the prior art.
Figure 1A:
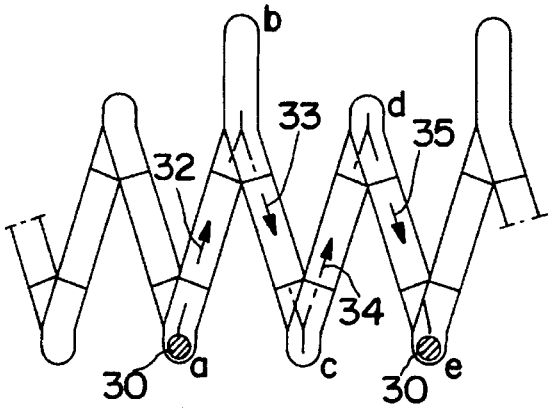
FIG. 1A PRIOR ART

FIGS. 1 and 1A illustrate the prior art described in document FR-2,670,824: The body of the device consists of the assembly of two connections 15 and 16 according to conventional methods. Upper connection 15 contains actuating shaft 17 whose displacements are to be controlled. This shaft is hollow. The direction of flow of the fluid corresponds to the direction of arrow 18. The end of shaft 17 bears the assembly consisting of a flow bean holder 19, a flow bean 20 and a return spring 21. Seal joints 22 complete the assembly. A bidirectional valve 50 allows the pressure between the chamber of spring 21 and the outside to be equalized. Flow bean 20 has thus the shape of an annular piston of differential section whose larger section is upstream from the flow.

Lower connection 16 contains a piston 23 to which needle 24 is immovably fastened by means of a brace 25. This brace 25 is suited for allowing passage of the fluid circulation in the direction of arrows 26. Annular piston 23 includes at least one seal 27 substantially at the lower end thereof, the upper seal assembly 27 being optional, a return spring 28 and a section restriction 29.

At least one finger 30 co-operates with a groove 31 machined in the body of piston 23. This assembly constitutes a non limitative example of the system for adjusting the stroke of piston 23 secured with needle 24.

FIG. 1A is a developed view of said groove 31 borne by piston 23. The groove is continuous over the circumference of the outer surface of piston 23. It consists of an integral number of pitches. The M-shaped trace formed by the groove connecting points a, b, c, d and e represents one pitch. Arrows 32, 33, 34 and 35 show the direction of displacement of finger 30 in said groove when going respectively from a to b, from b to c, from c to d and from d to e. A complete cycle is performed from a to e. During the sliding displacement of piston 23, the latter undergoes a rotation due to the inclination of each groove portion with respect to the axis of the piston. The direction of displacement of the finger(s) in the groove is irreversible owing to the difference in altitude or recess of the groove bottom between two consecutive vertices, and to a return means leaning the finger against the groove bottom, as described in prior documents. The circulation rate in the direction of arrow 18 creates a hydrodynamic force on the assembly consisting of needle 24 and piston 23. This force is adjusted according to the passageway restriction 29 located in the piston. When said force is higher than the force exerted by return spring 28, the piston goes down until it is stopped for example by finger 30 in groove 31 when the finger is at b. In this adjustment, the throttling of the fluid passageway has a minimum value and actuation is not possible because the pressure drop is not sufficient.

A flow rate decrease causes the needle to go up and finger 30 moves to c (FIG. 1A). Another flow rate increase sufficient to force the needle back then moves finger 30 towards position d. In this adjustment position, the pressure drop created by an activation flow rate acts upon the activation piston.

In document FR-A-2,670,824, adjustments are obtained successively through a series of flow rate variations. Furthermore, after each circulation stop, operators may be uncertain about the nature of the next adjustment if they do not know for certain the position of the finger (a or c) when the flow rate is zero or low and when the needle is in the position called position of rest.

According to a first embodiment, the present invention proposes to add means for controlling the adjustment of the needle displacement by changing the system of finger (30) and of groove (31).

Figure 2:
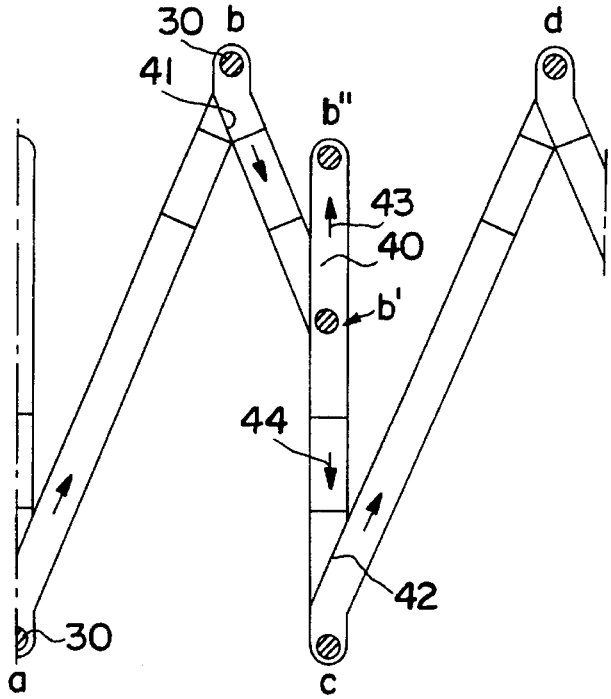
FIG. 2 shows a first embodiment of the control means.

FIG. 2 shows a pattern of groove 31 in which a pitch is represented by the successive points a, b, b', b" and c.

One pitch of the groove thus consists of three groove sections: ab, bb', b"c. A difference in altitude of the groove bottom prevents any back motion of finger 30 from b to a, from b' to b or from c to b' or b". The finger always moves from a to c. After lines 41, 40 and 42, the groove deepens by some millimeters so that the finger pushed towards the groove bottom by a spring can only be moved in one direction: from a to b, from b to b' and from c to d. Besides, when the finger is in the neighbourhood of point b', it may be driven towards b" or towards c as long as it has not passed line 42. This displacement in the directions shown by arrows 43 and 44 will depend on controlled conditions of the flow rate value in the pipe.

The distance between positions b and b", in the axial direction, represents the difference of recoil of the needle with respect to the flow bean. At b, the passageway opening is in the maximum position, which corresponds to the drilling position with no activation. At b", the passageway opening is less, which corresponds to the activation position since a flow rate value, generally less than the nominal drilling flow rate, will provide a sufficient pressure drop to activate the equipment.

Position b" may be obtained through a particular variation sequence of the rate of flow.

The operating procedure of the actuating device according to the present invention is the following:

When the circulation rate of drilling fluid Q is less than a flow rate Qmini, the hydrodynamic force on piston 23 bearing needle 24 becomes less than the return force of spring 28. Needle 24 takes up a position called a position of rest, in which it is introduced at the maximum in flow bean 20. Finger 30 is at one of points a or c, or one of the equivalent points of the whole of the groove made up of several pitches.

When the operator increases the circulation rate up to a value greater than Qmini, the needle moves back with respect to the flow bean under the action of the hydrodynamic forces and finger 30 moves in the groove towards points b or d or equivalent. For a circulation rate value at least greater than a value Qf or nominal flow rate during drilling, the needle reaches its maximum recoil position by being stopped by means of finger 30 which is itself stopped at points b or d or equivalent.

In this position (drilling for example), when the operator decreases the flow rate to less than Qf and at least to Qmini, the needle moves up to its position of rest and finger 30 goes from b to b', then to c. Every time the operator stops circulation, for example to add a pipe, there is no risk of causing an activation of the equipment by carrying out these flow rate variation sequences. These natural sequences, very common in the profession, may thus be performed without creating any interference with the equipment to be actuated. This simplifies the introduction of such a device in a string because, for the drill man, the device is operationally "transparent".

The operator performing flow rate variation sequences between the two values: a value less than or equal to Qmini and a value at least greater than Qf, knows necessarily that, below Qmini, the needle is in its position of rest and that thereafter a flow rate increase above Qf will enable it to reach the position where, in circulation at a drilling flow rate, there will be no activation of the equipment.

The operator will carry out a particular flow rate variation sequence to obtain activation only when he wishes to perform an activation.

Activation method

The activation sequence starts when the needle is in the position called drilling position. i.e. the circulation rate is at least established higher than or equal to Qf. Finger 30 is at b or d. The operator then decreases the flow rate down to a value Qr, intermediate between Qf and Qmini, so that the forward motion of needle 24 sets finger 30 after line 40, for example in position b'. The operator then increases the flow rate until at least a value Qa is reached. The hydrodynamic force causes the needle to move back, i.e. finger 30 moves in the groove in the direction of arrow 43 towards position b". The needle will thus not move as far as the position called the drilling position and will be stopped in a relatively close position with respect to the flow bean. Said position corresponds to the position b" of the finger in the groove. The circulation rate Qa in the restricted passageway between the flow bean and the needle creates then a pressure drop upstream on shaft 18 and initiates an actuation.

After actuation, the operator decreases the flow rate at least below value Qmini so as to possibly take up the drilling position again.

The force of spring 28 is a known function of the compression length, the hydrodynamic force on the needle may also be known as a function of the flow rate values and of the relative position of the needle and of the flow bean. It is therefore possible to determine a flow rate Qr for which the displacement of the needle is such that finger 30 passes line 40 but does not reach line 42.

Figure 3:
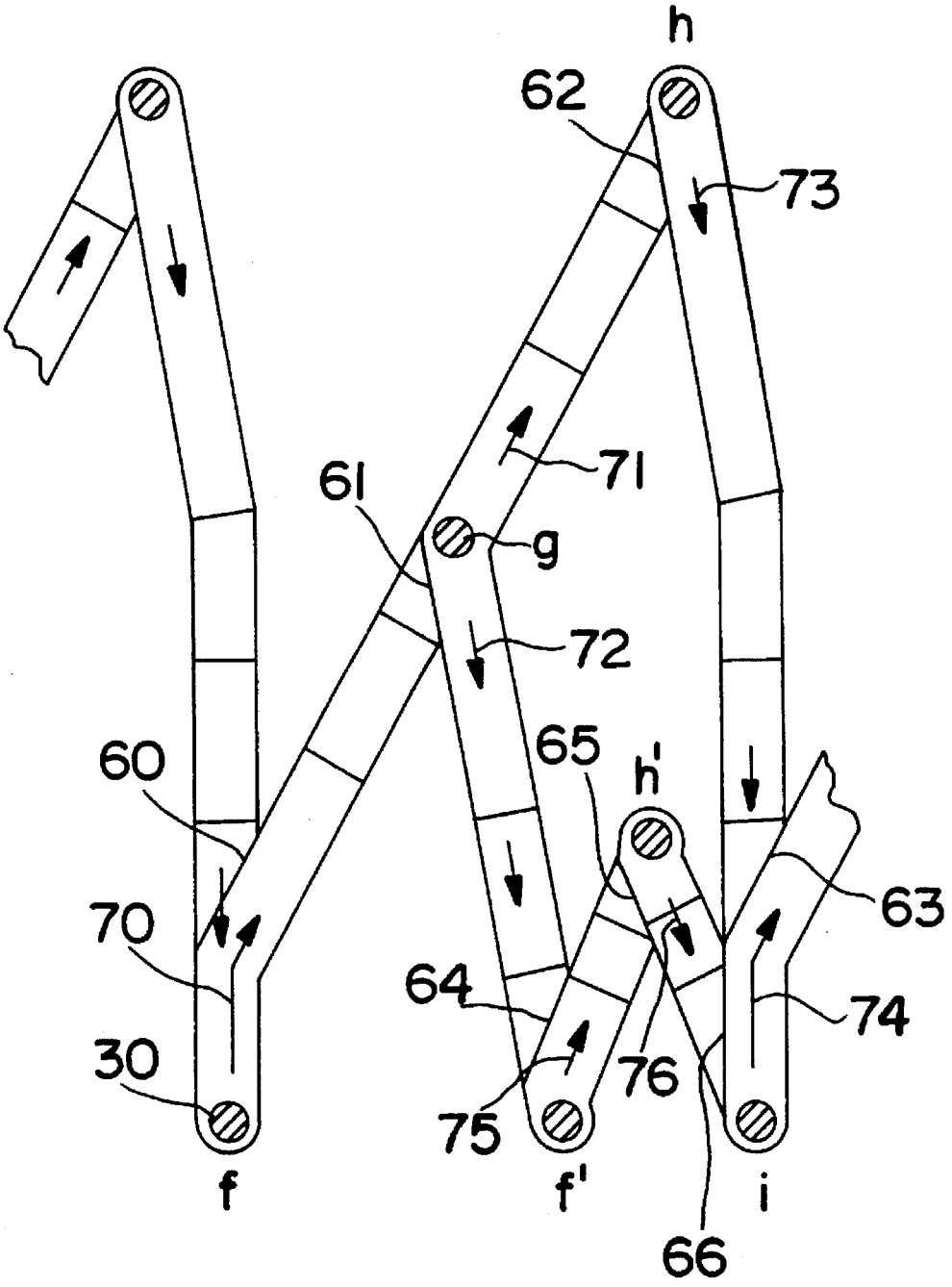
FIG. 3 shows a second embodiment of the control means.

FIG. 3 shows another pattern of groove 31 in which one pitch is represented by points f, g, h, h', f and i. There may be as many fingers 30 as there are pitches.

One pitch of the groove thus consists of several groove sections: hf, hi, gf, fh' and h'i. A difference in altitude of the groove bottom prevents any back motion of the finger from g to f, from h to g, from f to g, from h' to f and from i to h or h'. The finger thus always moves from f to i, by passing either through h or through h'. After lines 60, 61, 62, 63, 64, 65 and 66, the groove deepens by some millimeters so that the finger pushed towards the groove bottom by a spring can only be moved in one direction: from f to g, from g to h or f', from h to i, from i in the direction of arrow 74, from f to h', and from h' to i. Besides, when the finger is in the neighbourhood of point g, it may be driven towards h or towards f as long as it has not passed lines 62 or 64. This displacement in the directions shown by arrows 71 and 72 will depend on controlled conditions of the flow rate value in the pipe.

The distance between positions h and h', according to the axial direction, represents the difference of recoil of the needle with respect to the flow bean. At h, the passageway opening is in the maximum position, which corresponds to the drilling position where there is no activation. At h', the passageway opening is less, which corresponds to the activation position because, for a flow rate value Qa generally less than the nominal drilling flow rate, it will lead to a sufficient pressure drop to activate the equipment.

Position h' may be obtained through a particular variation sequence of the rate of flow.

The operating method of the actuation device according to the second embodiment of the present invention is the following:

When the circulation rate of drilling fluid Q is less than a flow rate Qmini, the hydrodynamic force on piston 23 bearing needle 24 becomes less than the return force of spring 28. Needle 24 then takes up a position called a position of rest in which it is introduced to the maximum in flow bean 20. Finger 30 is located at one of points f or i, or one of the equivalent points of the whole of the groove made up of several pitches.

When the operator increases the circulation rate up to a value greater than Qmini, the needle moves back with respect to the flow bean under the action of the hydrodynamic forces and finger 30 moves in the groove towards point h or equivalent in groove 31. For a circulation rate value at least greater than a value Qf or nominal flow rate during drilling, the needle reaches its maximum recoil level by being stopped by means of finger 30 which is itself stopped at point h or equivalent points.

In this position (drilling for example), when the operator decreases the flow rate below Qf and at least down to Qmini, the needle moves up to its position of rest and finger 30 passes from h to i. Every time the operator stops circulation, for example to add a pipe, there is no risk of causing an activation of the equipment by carrying out these flow rate variation sequences. These natural sequences, very common in the profession, may thus be performed without creating any interference with the equipment to be actuated. This simplifies the introduction of such a device in a string because, for the drill man, the device is operationally "transparent".

The operator performing flow rate variation sequences between the two values: a value less than or equal to Qmini and a value at least greater than Qf, knows necessarily that, below Qmini, the needle is in the position of rest f and that thereafter a flow rate increase above Qf will enable it to reach position h where, in circulation at a drilling flow rate, there will be no activation of the equipment.

The operator will carry out a particular flow rate variation sequence to obtain activation only when he wishes to perform an activation.

Activation method

The activation sequence starts when the needle is in the position called the position of rest, i.e. the circulation rate is at most established at Qmini. Finger 30 is at f or i. The operator then increases the flow rate up to a value Qr, intermediate between Qf and Qmini, so that the recoil of needle 24 sets finger 30 after line 61, for example in position g. The operator then decreases the flow rate until at least value Qmini is reached. The force of spring 28 causes the needle to move forward, i.e. finger 30 moves within the groove in the direction of arrow 72 towards position f. A new flow rate increase will thus cause the needle to move back by a distance shorter than the recoil of the needle in the drilling position. The needle is stopped in a position which is relatively close with respect to the flow bean. Said position corresponds to position h' of the finger in the groove. Circulation rate Qa in the restricted passageway between the flow bean and the needle creates then a pressure drop upstream on shaft 18 and initiates an actuation.

After actuation, the operator decreases the flow rate at least below value Qmini in order to move finger 30 from position h' to position i in the direction of arrow 76, and to take up the drilling position again.

The force of spring 28 is a known function of the compression length, the hydrodynamic force on the needle may also be known as a function of the flow rate values and of the relative position of the needle and of the flow bean. It is therefore possible to determine a flow rate Qr for which the displacement of the needle is such that finger 30 passes line 61, without however reaching line 62.

Without departing from the scope of this invention, the pattern of the groove may be different from those shown here by way of examples. In fact, several groove patterns are possible to reach the same technical result.

In order to increase the stability and the precision of the control device, a system for slowing down or for damping the displacement of the needle when it is in the position corresponding to the position of inversion of its displacement may be provided. According to the embodiment shown in FIG. 2, the system for slowing down or for damping finger 30 may be located in the neighbourhood of b', on section b"c and before line 42. According to the embodiment shown in FIG. 3, the system for slowing down or for damping finger 30 may be located in the neighbourhood of g, on section fh, after line 61 and before lines 62 or 64.

We claim:

1. A method for actuating an equipment from a distance, said actuation being performed through a variation of the conditions of flow of a fluid in a pipe, said equipment including means of coupling with an actuating device comprising adjusting means suited for varying the geometric characteristics of the passageway of said fluid through the hydrodynamic action of the flow of said fluid in said pipe, comprising the following stages:

varying the circulation rate at least between a value Qmini and a value Qf, Qmini being less than Qf, performing a first variation of the circulation rate from one or the other of said values Qf or Qmini so as to reach a value Qr, Qr being an immediate flow rate value between Qmini and Qf, then performing, from Qr, a second variation in the opposite direction with respect to said first variation.

2. A method as claimed in claim 1, wherein said equipment is not activated when a flow rate variation is performed between a value at most equal to Qmini and a value at least equal to Qf and conversely.

3. A method as claimed in claim 1, comprising the following stages:

perforating said first variation from a flow rate value at most equal to Qmini and up to value Qr, then performing said second variation in the opposite direction at least to value Qmini, then performing another flow rate variation in the same direction as said first variation up to a value Qa for which said equipment is activated.

4. A method as claimed in claim 1, comprising the following stages:

performing said first variation from a flow rate value at least equal to Qf and up to value Qr, then performing said second variation in the opposite direction at least up to a value Qa for which said equipment is activated.

5. A device for actuating an equipment from a distance, said actuation being performed through a variation of the conditions of flow of a fluid in a pipe, including coupling means between said device and said equipment, adjusting means suited for varying the geometric characteristics of the passageway of said fluid through the hydrodynamic action of the flow of said fluid in said pipe, said adjusting means including a continuous groove consisting of at least one set including at least three groove sections delimited each by an origin point and an end point, an indexing means cooperating with said groove, the position of said indexing means in said groove corresponding to an adjustment of said adjusting means, wherein one of the origin or end points of one of the sections is located between the origin point and the end point of another section.

6. A device as claimed in claim 5, wherein said sections include a system preventing said indexing means located at the end point of one of the sections from being moved in the direction of the origin point of this section.

7. A device as claimed in claim 6, wherein said system includes a retractable finger and a groove of variable depth.

8. A device as claimed in claim 5, wherein said set includes three sections, the origin point of a second section corresponds to the end point of a first section, the end point of the second one is located between the end point and the origin point of a third section and the end point of the third section corresponds to the origin point of another set.

9. A device as claimed in claim 5, wherein said set includes at least three sections, the end point of a first section merges with the origin point of a second section whose end point merges with the origin point of another set, the origin point of a third section is located between the origin point and the end point of the first section, the end point of said third section merges with the origin point of a subset of continuous grooves whose end point merges with the end point of the second section.

10. A device as claimed in claim 9, wherein said subset includes at least two V-shaped sections, when said indexing means is located at the point of the V, said adjusting means allow activation, and when the indexing means is located at the common point of the first section and of the second section, said adjusting means do not allow activation.

11. A device as claimed in claim 5, wherein said equipment comprises a drill string comprising a stabilizer and/or a bent sub.

12. A method as claimed in claim 1, wherein a drill string in which a stabilizer and/or a bent sub are remote controlled according to said method.

* * * * *